US006720506B2

(12) United States Patent
Sahashi

(10) Patent No.: US 6,720,506 B2
(45) Date of Patent: Apr. 13, 2004

(54) DOOR SWITCH DEVICE FOR VEHICLE

(75) Inventor: Kazuharu Sahashi, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/187,372

(22) Filed: Jul. 2, 2002

(65) Prior Publication Data

US 2003/0006127 A1 Jan. 9, 2003

(30) Foreign Application Priority Data

Jul. 5, 2001 (JP) ..... P2001-204734

(51) Int. Cl.[7] ..... H01H 3/16
(52) U.S. Cl. ..... 200/61.73; 200/295; 200/296
(58) Field of Search ..... 200/61.73, 293, 200/61.76, 295, 61.62, 296; 296/187, 202, 207, 146.5; 248/27.3, 27.1

(56) References Cited

U.S. PATENT DOCUMENTS 4,461,938 A * 7/1984 Sorenson ..... 200/296
4,947,010 A * 8/1990 Heydner et al. ..... 200/296
5,283,710 A 2/1994 Hamilton et al. ..... 361/212
5,343,007 A * 8/1994 Roeser et al. ..... 200/296
5,527,991 A * 6/1996 Sadowski et al. ..... 174/51

* cited by examiner

*Primary Examiner*—Michael Friedhofer
*Assistant Examiner*—Lisa Klaus
(74) *Attorney, Agent, or Firm*—Morgan, Lewis & Bockius LLP

(57) ABSTRACT

Each mounting member (16) is formed by a resilient sheet of an intermediate portion-widened shape which is increasing in sheet width gradually from its distal side, defined with respect to a direction of insertion of the mounting member into a mounting hole (26) in a vehicle body (25), to its intermediate portion, and then is decreasing in sheet width gradually from the intermediate portion to its proximal side defined with respect to the inserting direction, and this mounting member is inserted into the mounting hole and opposite side edges (16*a*) of the mounting member are brought into sliding contact with an inner edge (26*a*) of the mounting hole, so that the mounting member is curved between this inner edge and a switch body, and the opposite side edges are press-contacted with the inner edge of the mounting hole by a restoring resilient force of the mounting member.

13 Claims, 3 Drawing Sheets

DOOR SWITCH DEVICE FOR VEHICLE

BACKGROUND OF THE INVENTION

This invention relates to a vehicle door switch device having an improved mounting member.

FIGS. 5 and 6 show a conventional door switch device for a vehicle such as an automobile. In this conventional vehicle door switch device, a cover 2 made of an elastic material such as rubber is mounted on a switch body 1, and mounting members 3 are mounted on the switch body. The two mounting members 3 are formed by a resilient metal sheet in integrally-connected relation to each other, and one of the two mounting members is provided on one side (the upper side in the drawings) of the switch body 1 while the other mounting member is provided on the other side (the lower side in the drawings) of the switch body disposed in symmetrical relation to the one side. The one mounting member 3 is bent into a generally inverted V-shape, with its middle portion spaced apart from the switch body 1, while the other mounting member 3 is bent into a generally V-shape in symmetrical relation to the above inverted V-shape, with its middle portion spaced apart from the switch body. Dots-and-dash lines shown in FIG. 1 indicates a normal condition that an external force is not applied to each mounting member.

A contact element 4 is provided at a distal end of the switch body 1 remote from the cover 2, and is held in contact with the mounting members 3, and a conductor wire 6 is connected to this contact member 4 via a connection terminal 5.

A vehicle body 7 includes a mounting hole 8, and a coating is formed on the vehicle body 7 over an entire surface thereof, including an inner edge 8*a* of the mounting hole 8. In this condition, the switch body 1, together with the mounting members 3, is inserted into the mounting hole 8 in the vehicle body 7 in such a manner that the conductor wire 6, the connection terminal 5 and the contact element 4 are arranged in this order from the distal side.

In this inserting process, each mounting member 3 is brought into sliding contact with the inner edge 8*a* of the mounting hole 8, and therefore is compressed from its normal condition, and its outwardly-projecting bent portion 3*a* passes through the mounting hole 8, so that the portion 3*a*' of the mounting member 3 disposed near to the bent portion 3*a* is press-contacted with the inner edge 8*a* of the mounting hole 8 (at the reverse side) by a restoring force, thereby retaining the switch body 1 against withdrawal. In the inserting process, each mounting member 3 scrapes the coating film from the inner edge 8*a* of the mounting hole 8, and in this condition the mounting member 3 is contacted with the vehicle body 7, and therefore is electrically connected to the vehicle body 7.

A positive electrode of a battery (not shown) on the vehicle is connected to the conductor wire 6 via a load (not shown) such as a room lamp, while a negative electrode of the battery is connected to the vehicle body 7. Therefore the mounting members 3 electrically connected to the vehicle body 7 are electrically connected to the negative electrode of the battery via the vehicle body 7.

In this mounted condition, when a door (not shown) of the vehicle is closed, the switch body 1 is pressed or operated through the cover 2, so that the contact element 4 is brought out of contact with the mounting members 3 (although this is not shown in detail in the drawings), and therefore the load, such as the room lamp, is de-energized. In this condition, when the door of the vehicle is opened, the pressing of the switch body 1 through the cover 2 is canceled, so that the contact element 4 is brought into contact with the mounting members 3, and therefore the load, such as the room lamp, is energized.

In recent years, the degree of rigidity of the coating, formed on the vehicle body 7, has increased. On the other hand, for obtaining the sufficient electrical connection between the mounting members 3 and the vehicle body 7, the pressure of contact of each mounting member 3 with the inner edge of the mounting hole 8 in the vehicle body 7 must be increased so that the mounting member 3 can sufficiently scrape the coating film from the inner edge 8*a* when the mounting member 3 slides in contact with the inner edge 8*a*.

In the above conventional vehicle door switch device, however, it is difficult to increase the pressure of contact of each mounting member 3 with the inner edge 8*a* of the mounting hole 8, and as a result the scraping of the coating film from the inner edge 8*a* of the mounting hole 8 can not effected sufficiently. Therefore there has been a fear that the sufficient electrical connection between the mounting members 3 and the vehicle body 7 is not achieved.

SUMMARY OF THE INVENTION

This invention has been made under the above circumstances, and an object of the invention is to provide a door switch device for a vehicle in which the pressure of contact of a mounting member with an inner edge of a mounting hole in a vehicle body can be sufficiently increased, so that a coating film can be sufficiently scraped from the inner edge of the mounting hole, thereby achieving the sufficient electrical connection between the mounting member and the vehicle body.

In order to solve the aforesaid object, the invention is characterized by having the following arrangement.

(1) A door switch device for a vehicle comprising:

a switch body; and a mounting member mounted on the switch body, wherein the mounting member is formed of a resilient sheet and has a width gradually increasing from a first end thereof to a intermediate portion thereof and gradually decreasing from the intermediate portion to a second end thereof;

wherein when the mounting member together with switch body is inserted, from the first end of the mounting member, into a mounting hole in a vehicle body having a coating film formed thereon, opposite side edges of the mounting member are brought into sliding contact with an inner edge of the mounting hole so that the mounting member scrapes the coating film from the inner edge of the mounting hole and is curved between the inner edge of the mounting hole and the switch body, thereby the opposite side edges are press-contacted with and electrically connected to the inner edge of the mounting hole by a restoring resilient force of the mounting member, and prevents the switch body from withdrawal.

(2) The door switch device according to (1), wherein a maximum width of the mounting member is larger than a chord length of a corresponding portion of the mounting hole where the mounting member is located.

(3) The door switch device according to (2), wherein a width at the first distal end of the mounting member is smaller than the diameter of the corresponding portion of the mounting hole.

(4) The door switch device according to (3), wherein a width at the second distal end of the mounting member is smaller than the diameter of the corresponding portion of the mounting hole.

(5) The door switch device according to (1), wherein a length between the first end and the intermediate portion is shorter than a length between the intermediate portion and the second end.

(6) The door switch device according to (1), wherein a pair of the mounting members are provided so as to interpose the switch body therebetween.

DETAILED DESCRIPTION OF PREFERRED EMBODIMENTS

One preferred embodiment of the present invention will now be described with reference to FIGS. 1 to 4.

Figure 4:
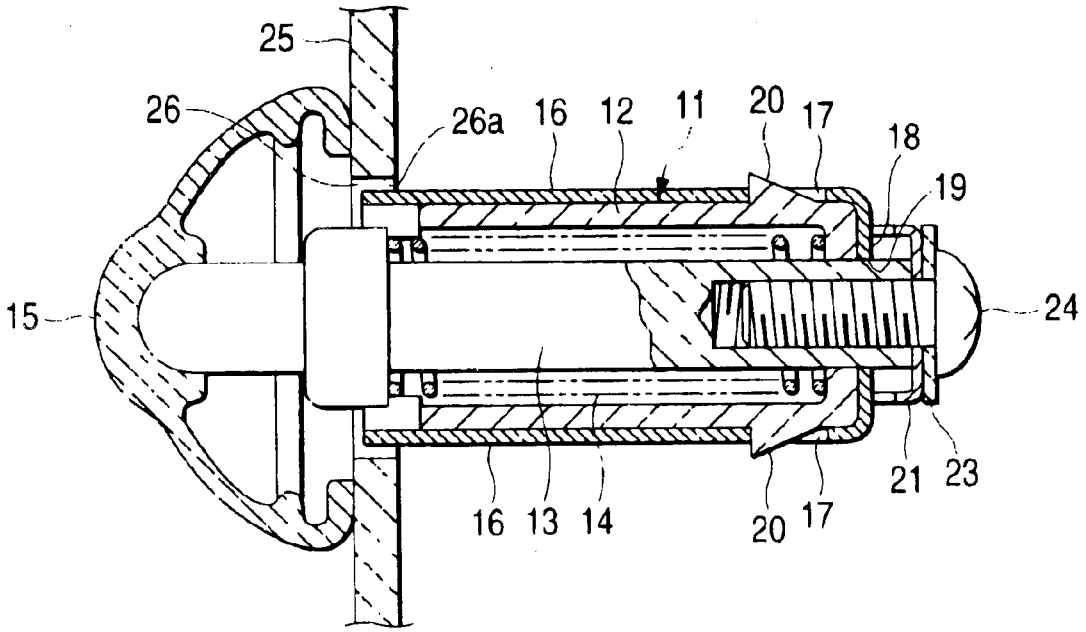
FIG. 4 is a longitudinal cross-sectional view showing the whole of the device in the mounted condition.

A switch body 11, shown in FIG. 4, comprises a cylindrical tubular casing 12, and an operating element 13 of a cylindrical shape which is smaller in diameter than the casing 12, and is inserted in the casing 12, and extends axially therethrough. The operating element 13 is slidable relative to the casing 12 in the axial direction (right and left in the drawings). A spring 14 is mounted within the casing 12, and the operating element 13 is urged by this spring 14, and is projected from the casing 12 in the left-hand direction (in the drawings). A cap-like cover 15, made of an elastic material such as rubber, is attached to this projected end portion of the operating element 13.

Figure 3:
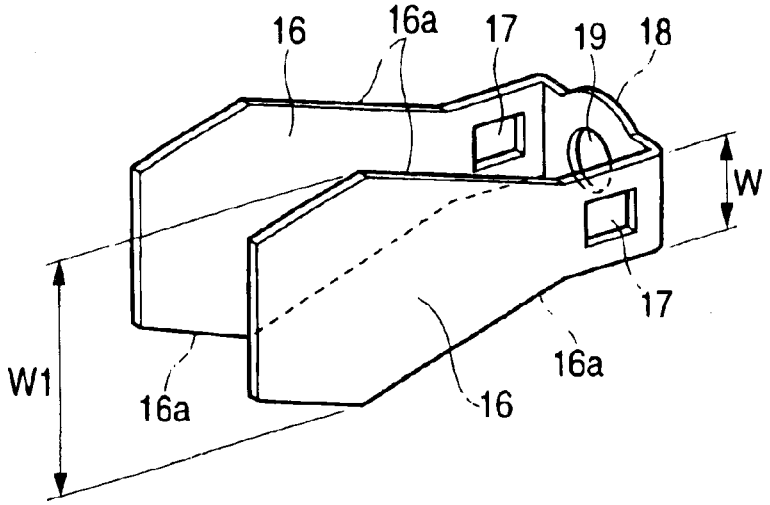
FIG. 3 is a perspective view of mounting members.

Mounting members 16 are mounted on the switch body 11 of this construction. One of the two mounting members 16 is provided on one side (the upper side in FIG. 4) of the switch body 11 while the other mounting member 16 is provided on the other side (the lower side in FIG. 4) of the switch body disposed in symmetrical relation to the one side. As shown in FIG. 3, the two mounting members 3 are formed integrally with each other, and are formed by bending a resilient sheet (preferably of electrically-conductive metal such as copper) into a generally U-shape.

Each of the mounting members 16 has an intermediate portion-widened shape, and is increasing in sheet width W gradually from a right end portion (in the drawings) thereof to an intermediate portion thereof (which, in this case, is disposed rather near to a left end thereof), and then is decreasing in sheet width W gradually from this intermediate portion to the left end thereof. An engagement hole 17 is formed through the right end portion of each of the mounting members 16, and an insertion hole 19 is formed through an interconnecting plate portion 18 which is common to these mounting members 16.

On the other hand, retaining projections 20 are formed respectively on the above opposite sides of the switch body 11 at the right end portion thereof, as shown in FIG. 4, and the mounting members 16 are fitted on the switch body 11 from the right side (FIG. 4), and the retaining projections 20 are retainingly engaged in the engagement holes 17, respectively, and by doing so, the mounting members 16 are attached to the switch body 11. As a result, the other end portion of the operating element 13, projecting right (in the drawings) from the casing 12 of the switch body 11, projects outwardly through the insertion hole 19 in the interconnecting plate portion 18.

Figure 1:
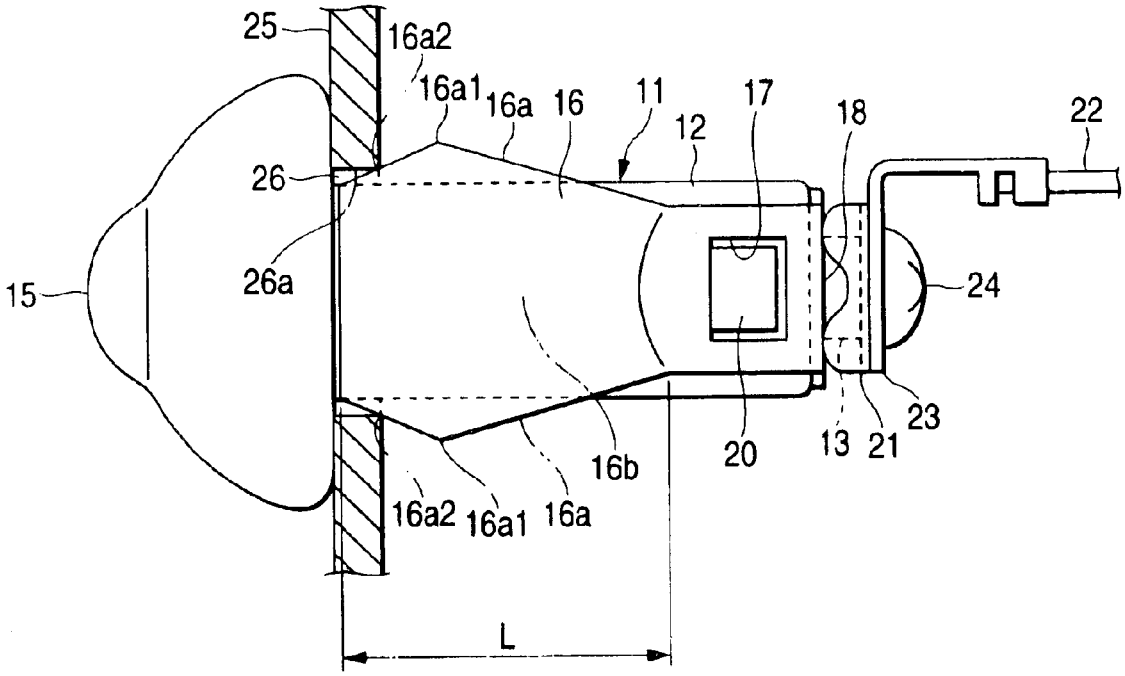
FIG. 1 is a side-elevational view of one preferred embodiment of the present invention, showing the whole of a device of the invention in its mounted condition.

A cap-like contact element 21 and a connection terminal 23 (to which a conductor wire 22 is connected as shown in FIG. 1) are fixedly secured to the (projected) other end of the operating element 13 by a screw 24, and by doing so, the contact element 21 is contacted with the interconnecting plate portion 18 (and hence the mounting members 16).

Figure 2:
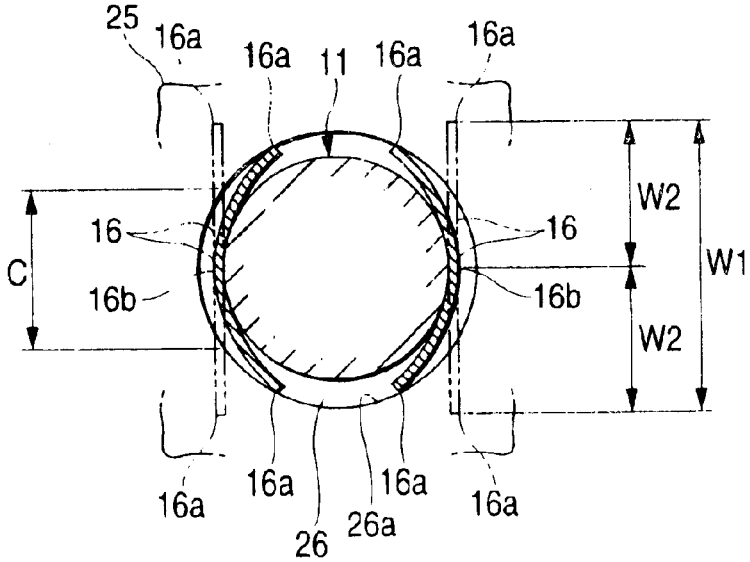
FIG. 2 is a transverse cross-sectional view showing the whole of the device in the mounted condition.

On the other hand, a vehicle body 25 has a mounting hole 26, and a coating is formed on the vehicle body 26 over an entire surface thereof, including an inner edge 26*a* of the mounting hole 26. As shown in FIG. 2, a maximum sheet width W1 of the mounting member 16 in its normal condition is larger than a chord length C of a corresponding portion of the mounting hole 26.

The switch body 11, together with the mounting members 16, is inserted into the mounting hole 26 in the vehicle body 25 from the left side (the exterior of the vehicle body 25) to the right side (the interior of the vehicle body 25) in FIG. 1 in such a manner that the conductor wire 22, the connection terminal 23 and the contact element 21 are arranged in this order from the distal side. As is clear, the right side in FIGS. 1 and 4 is the distal side with respect to the direction of insertion of the mounting members 16 into the mounting hole 26 while the left side is the proximal side with respect to the inserting direction.

In this inserting process, opposite side edges 16*a* of each mounting member 16 are brought into sliding contact with the inner edge 26*a* of the mounting hole 26. At this time, if the switch body 11, shown in FIG. 2, did not exist in the mounting hole 26, the whole of each mounting member 16, while remaining flat and straight, would be displaced gradually toward the center or axis of the mounting hole 26 as the opposite side edges 16*a* of each mounting member 16 slide in contact with the inner edge 26*a* of the mounting hole 26. However, the switch body 11 exists in the mounting hole 26, and therefore the displacement of a central portion 16*b* of each mounting member 16 toward the center of the mounting hole 26 is limited by the switch body 11.

As a result, only the opposite side edges 16*a* of each mounting member 16 are displaced toward the center of the mounting hole 26, and the mounting member 16 is curved at its opposite side portions each extending from the central portion 16*b* (which is prevented from displacement toward the center of the mounting hole 26) to the corresponding side edge 16*a*. Namely, each mounting member 16 is curved between the switch body 11 and the inner edge 26*a* of the mounting hole 26, and by its restoring resilient force, produced in this curved condition, the opposite side edges 16*a* of the mounting member 16 are press-contacted with the inner edge 26*a* of the mounting hole 26.

Each mounting member 16 is thus curved, and when that portion 16*a*1 of the mounting member 16, having the maximum sheet width W1, passes past the mounting hole 26 as shown in FIG. 1, that portion 16*a*2 of the mounting member 16, disposed near to the portion 16*a*1 having the maximum sheet width W1, is press-contacted with the inner edge 26*a* of the mounting hole 26 (at the reverse side) by the restoring resilient force, produced in the curved condition, thereby retaining the switch body 11 against withdrawal.

In this inserting process, the opposite side edges 16*a* of each mounting member 16 scrape the coating film from the inner edge 26*a* of the mounting hole 26, and in this condition the mounting member 16 is contacted with the vehicle body 25, and therefore is electrically connected to the vehicle body 25.

A positive electrode of a battery (not shown) on the vehicle is connected to the conductor wire 22 via a load (not shown) such as a room lamp, while a negative electrode of the battery is connected to the vehicle body 25, and therefore the mounting members 16, electrically connected to the vehicle body 25, are electrically connected to the negative electrode of the battery via the vehicle body 25.

In this mounted condition, when a door (not shown) of the vehicle is closed, the operating element 13 of the switch body 11 is pressed or operated through the cover 15 against the bias of the spring 14, so that the contact element 21 is brought out of contact with the interconnecting plate portion 18 (and hence the mounting members 16), and therefore the load, such as the room lamp, is de-energized. In this condition, when the door of the vehicle is opened, the pressing of the operating element 13 of the switch body 11 through the cover 15 is canceled, and the operating element 13 is returned by the bias of the spring 14, so that the contact element 21 is brought into contact with the interconnecting plate portion 18, and therefore the load, such as the room lamp, is energized.

In this construction, each of the mounting members 16 is formed by the resilient sheet of an intermediate portion-widened shape which is increasing in sheet width W gradually from its distal side (defined with respect to the direction of insertion of the mounting member 16 into the mounting hole 26 in the vehicle body 25) to its intermediate portion, and then is decreasing in sheet width W gradually from this intermediate portion to its proximal side defined with respect to the inserting direction. These mounting members 16 are inserted into the mounting hole 26, and the opposite side edges 16*a* of each mounting member are brought into sliding contact with the inner edge 26*a* of the mounting hole 26, and each mounting member 16 is curved between this inner edge and the switch body 11, and the opposite side edges 16*a* are press-contacted with the inner edge 26*a* of the mounting hole 26 by there storing resilient force, and by doing so, the pressure of contact of each mounting member 16 with the inner edge 26*a* of the mounting hole 26 in the vehicle body 25 can be made sufficiently high.

Figure 5:
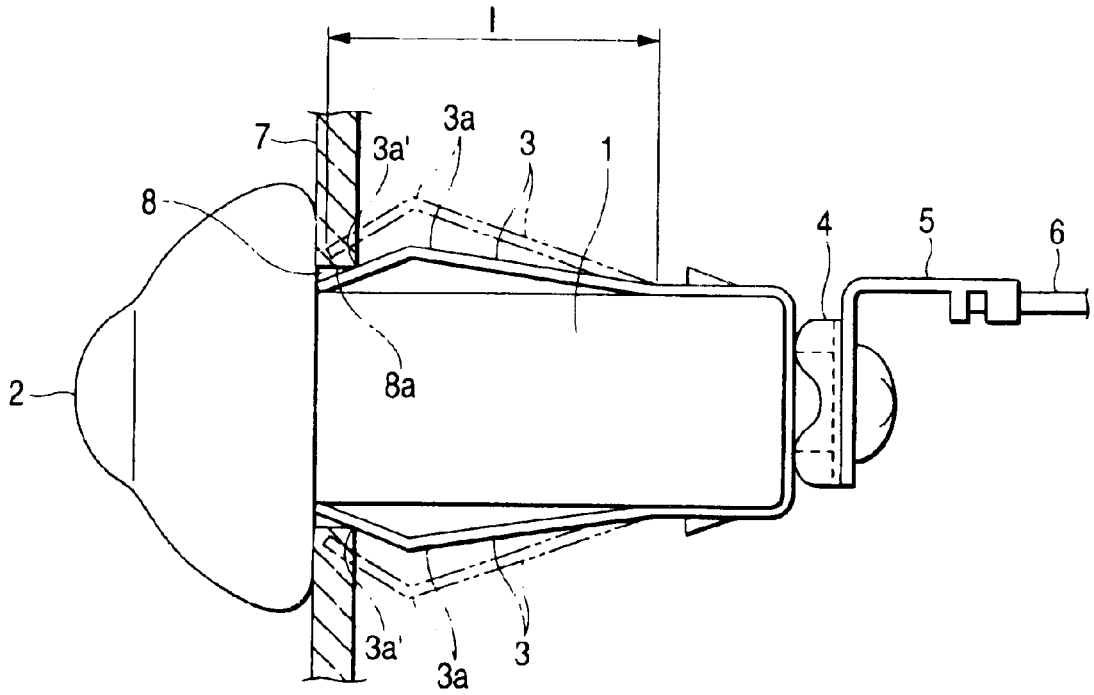
FIG. 5 is a view similar to FIG. 1, but showing a conventional example.
Figure 6:
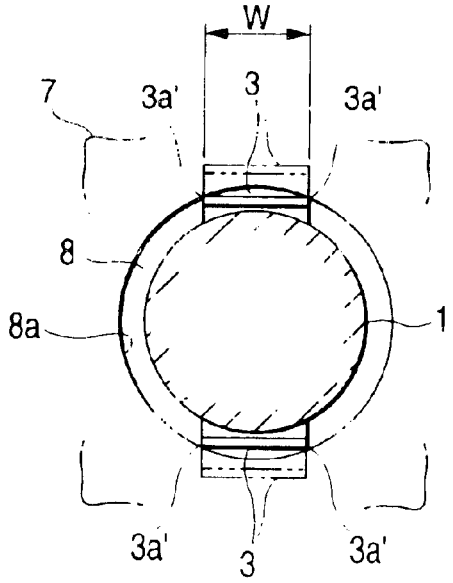
FIG. 6 is a view similar to FIG. 2.

And besides, in this construction, each mounting member 16 is increasing in sheet width W gradually to the intermediate portion thereof, and then is decreasing in sheet width gradually from this intermediate portion. Within the range of a large length L, shown in FIG. 1, each mounting member 16 can be curved at its opposite side portions each extending from the central portion 16*b* to the corresponding one of the opposite side edges 16*a*. Since the mounting member 16 has the width larger than a width w (see FIG. 6) of that portion of the conventional mounting member 3 which can be resiliently deformed, larger pressure of the contact can be applied to the inner edge 26*a* of the mounting hole 26. Furthermore, in this case, a width W2 (see FIG. 2) of the opposite side portions of the mounting member 16, each extending from the central portion 16*b* to the corresponding one of the opposite side edges 16*a*, is smaller than the length l of that portion of the conventional mounting member 3 (shown in FIG. 5) which can be resiliently deformed, and therefore the higher restoring resilient force can be obtained even if the amount of resilient deformation (the amount of curving) is generally the same as that of the conventional mounting member.

As a result, even if the degree of rigidity of the coating on the vehicle body 25 is increased, the scraping of the coating film from the inner edge 26*a* of the mounting hole 26 by the mounting members 16 can be effected sufficiently, and the sufficient electrical connection between the mounting members 16 and the vehicle body 25 can be obtained.

The present invention is not limited to the embodiment described above and shown in the drawings, and particularly the specific construction of the switch body 11, the specific opening-closing structure, including the illustrated contact element 21 for movement with the operating element 12, and so on can be suitably changed without departing from the scope of the invention.

As described above, in the vehicle door switch device of the present invention, the pressure of contact of the mounting members with the inner edge of the mounting hole in the vehicle body can be made sufficiently high, and the scraping of the coating film from the inner edge of the mounting hole can be effected sufficiently, and therefore the sufficient electrical connection between the mounting members and the vehicle body can be obtained.

What is claimed is:

1. A door switch device for a vehicle comprising:

a switch body; and a mounting member mounted on the switch body, wherein the mounting member is formed of a resilient sheet and includes first and second opposite edges and a surface extending from the first opposite edge to the second opposite edge, the surface has a first width measure from the first edge to the second edge and along a first portion of the surface, a second width measured from the first edge to the second edge and along a second portion of the surface, and a third width measured from the first edge to the second edge along a third portion of the surface, the second portion being intermediate the first and third portions, such that the second width is greater than each of the first and third widths and the surface gradually increases in width from the first width to the second width and gradually decreases in width from the second width to the third width;

wherein when the mounting member together with switch body is inserted, from a first end of the mounting member, into a mounting hole in a vehicle body having a coating film formed thereon, the opposite side edges of the mounting member are brought into sliding contact with an inner edge of the mounting hole so that the mounting member scrapes the coating film from the inner edge of the mounting hole and the surface is curved between the inner edge of the mounting hole and the switch body, thereby the opposite side edges are press-contacted with and electrically connected to the inner edge of the mounting hole by a restoring resilient force of the mounting member, and prevents the switch body from withdrawal.

2. The door switch device according to claim 1, wherein a maximum width of the mounting member is larger than a chord length of a corresponding portion of the mounting hole where the mounting member is located.

3. The door switch device according to claim 2, wherein a width at a first end of the mounting member is smaller than the diameter of the corresponding portion of the mounting hole.

4. The door switch device according to claim 3, wherein a width at a second end of the mounting member is smaller than the diameter of the corresponding portion of the mounting hole.

5. The door switch device according to claim 1, wherein a length between the first end and the intermediate portion is shorter than a length between the intermediate portion and the second end.

6. The door switch device according to claim 1, wherein a pair of the mounting members are provided so as to interpose the switch body therebetween.

7. A door switch device for a vehicle comprising:

a switch body having an outer surface; and a resilient mounting member including a first end being connected to the switch body, a second end, first and second opposite edges extending from the first end to the second end, and a surface extending from the first opposite edge to the second opposite edge, the first and second opposite edges being spaced from the switch body and a portion of the surface intermediate the first and second opposite edges engaging the outer surface of the switch body such that when the mounting member together with switch body is inserted, from the first end of the mounting member, into a mounting hole in a vehicle body having a coating film formed thereon, the opposite side edges of the mounting member are brought into sliding contact with an inner edge of the mounting hole so that the mounting member scrapes the coating film from the inner edge of the mounting hole and the surface of the mounting member is curved between the inner edge of the mounting hole and the switch body, thereby the opposite side edges are press-contacted with and electrically connected to the inner edge of the mounting hole by a restoring resilient force of the mounting member, and prevents the switch body from withdrawal.

8. The door switch device according to claim 7, wherein the outer surface of the switch body comprises a cylindrical outer surface.

9. The door switch device according to claim 8, wherein the surface of the mounting member comprises a flat surface.

10. The door switch device according to claim 9, wherein each of the first and second edges comprises a first straight edge portion and a second straight edge portion extending at an angle from the first edge portion.

11. The door switch device according to claim 10, wherein the flat surface extends from the first end of the mounting member to the second end of the mounting member.

12. The door switch device according to claim 7, wherein a mounting member surface has a first length measured from the first end of the mounting member to the second portion of the surface and a second length measured from the second portion of the surface to the second end, the second length being less the first length.

13. The door switch device according to claim 7, further comprising an additional mounting member mounted to the switch body and extending along the switch body such that the switch body is interposed with the mounting member and the additional mounting member.

* * * * *